US009056739B2

(12) United States Patent
Schulze-Hagenest et al.

(10) Patent No.: US 9,056,739 B2
(45) Date of Patent: Jun. 16, 2015

(54) SHEET INVERTER AND METHOD FOR INVERTING A SHEET

(71) Applicants: Detlef Schulze-Hagenest, Molfsee (DE); Alexander Hubertus Klang, Munich (DE)

(72) Inventors: Detlef Schulze-Hagenest, Molfsee (DE); Alexander Hubertus Klang, Munich (DE)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 14/063,260

(22) Filed: Oct. 25, 2013

(65) Prior Publication Data

US 2014/0116844 A1 May 1, 2014

(30) Foreign Application Priority Data

Oct. 31, 2012 (DE) ..... 10 2012 021 383

(51) Int. Cl.

| | |
|---|---|
| ***B65H 15/00*** | (2006.01) |
| ***B65H 29/24*** | (2006.01) |
| ***B65H 5/02*** | (2006.01) |
| ***B65H 5/22*** | (2006.01) |
| ***G03G 15/23*** | (2006.01) |
| ***B65H 29/52*** | (2006.01) |
| ***B65H 85/00*** | (2006.01) |
| *G03G 15/00* | (2006.01) |

(52) U.S. Cl.

CPC ..... *B65H 15/00* (2013.01); *B65H 29/242* (2013.01); *B65H 5/023* (2013.01); *B65H 5/224* (2013.01); *G03G 15/234* (2013.01); *G03G 15/6517* (2013.01); *B65H 2301/33212* (2013.01); *B65H 2301/33224* (2013.01); *B65H 2404/2615* (2013.01); *B65H 2801/06* (2013.01); *B65H 29/52* (2013.01); *B65H 85/00* (2013.01); *B65H 2301/44735* (2013.01); *B65H 2301/5321* (2013.01); *B65H 2301/5322* (2013.01); *B65H 2404/15212* (2013.01); *B65H 2404/2641* (2013.01); *B65H 2513/108* (2013.01)

(58) Field of Classification Search

CPC ..... B65H 2301/3321; B65H 2301/33212; B65H 2301/33224

USPC ..... 271/291, 65, 66, 70, 184–186, 225; 399/364; 414/785, 759; 198/402, 403

See application file for complete search history.

(56) References Cited

U.S. PATENT DOCUMENTS

| | | | | |
|---|---|---|---|---|
| 3,685,471 | A * | 8/1972 | Reynolds | 112/470.36 |
| 5,201,399 | A * | 4/1993 | Dietrich | 198/409 |
| 5,971,697 | A * | 10/1999 | Ballestrazzi et al. | 414/788.3 |

(Continued)

FOREIGN PATENT DOCUMENTS

| | | |
|---|---|---|
| DE | 102007025085 | 9/2008 |

*Primary Examiner* — Jeremy R Severson

(74) *Attorney, Agent, or Firm* — Raymond L. Owens

(57) ABSTRACT

A sheet inverter having two spaced apart sheet transport units and a rotation device, the rotation device supporting the sheet transport units in a rotatable manner about a common axis of rotation, the sheet transport units each includes at least one transport element, which provides a direction of transport that extends parallel to the axis of rotation; and a controllable drive unit for driving the transport element. The rotation device moves the sheet transport units in an alternating manner between an input position and an output position, wherein the sheet transport unit in the input position is aligned with a transport unit arranged upstream to the sheet inverter and the sheet transport unit in the output position is aligned with a transport unit arranged downstream from the sheet inverted.

20 Claims, 3 Drawing Sheets

(56) References Cited

U.S. PATENT DOCUMENTS

| | | | | |
|---|---|---|---|---|
| 6,378,690 | B1 * | 4/2002 | Pessina et al. | 198/414 |
| 6,527,100 | B2 * | 3/2003 | Ballestrazzi et al. | 198/373 |
| 6,626,103 | B2 | 9/2003 | Neumann | |
| 7,165,493 | B2 * | 1/2007 | Behrens | 101/477 |
| 7,819,401 | B2 * | 10/2010 | Moore | 271/314 |
| 8,181,767 | B2 * | 5/2012 | Gales et al. | 198/404 |
| 8,579,279 | B2 * | 11/2013 | Kagoshima et al. | 271/185 |
| 8,579,281 | B1 * | 11/2013 | Thompson et al. | 271/186 |

* cited by examiner

SHEET INVERTER AND METHOD FOR INVERTING A SHEET

CROSS-REFERENCE TO RELATED APPLICATION

This application claims priority of German Patent Application 102012021383.2 filed Oct. 31, 2012 which is incorporated herein by reference in its entirety.

FIELD OF THE INVENTION

The present invention relates to a sheet inverter and a method for inverting sheets in a printer.

BACKGROUND OF THE INVENTION

In the printing industry different types of sheet inverters are known, which are typically used in a duplex path of the printer. One type of sheet inverter, which is for example described in U.S. Pat. No. 6,626,103 B1 enables the leading edge of a sheet to remain the same before and after inversion of the sheet. This can be beneficial for registered printing on the front and backside of the sheet.

This known sheet inverter has two transport belts, which are entrained about respective pairs of rollers. The belts are guided in a figure eight configuration around the respective pairs of rollers such that in each free section thereof, extending between the roller pairs, a 180° twist is present. The first and second pairs of rollers are arranged adjacent to each other, such that a section containing the 180° twist of one belt contacts a corresponding section of the other belt, thereby forming a transport path there between, having said 180° twist. The twist forces a sheet, which is received and transported between the belts, to twist along the contact line and to turn by 180°, while it is transported along the transport path. The inverter also has a guide wire for guiding an edge portion of the sheet upwards and across the transport path.

This arrangement is suitable for a wide range of sheets, which can differ with respects to stiffness and dimensions. With respect to long sheets, in particular, sheets having a length (in the direction of transport), which is longer than half the length of the transport path through the sheet inverter, this arrangement can cause problems, as explained herein below. In this case, when the leading edge of the sheet reaches the midpoint of the transport path, both the twist in the transport path and the guide wire urge the sheet into an upright orientation. While the transport path urges only a middle section of the sheet into the upright orientation, the guide wire urges the edge section of the sheet into the upright orientation. When the sheet is longer than half the length of the transport path, the trailing edge will still be held in a horizontal position between the entrance group of rollers at the entrance end of the transport path. This situation can lead to paper jams, undue high stress in the sheet and in particular to artifacts in a printed image on a surface of the sheet due to excessive bending thereof. This problem is obviously more pronounced the longer and stiffer the sheet, which is particularly true for packing material such as cardboard. Also, with wider formats, the guidance of the edge section is problematic.

Further, reference is made to DE 10 2007 025 085 B3, which discloses a sheet inverter for bank notes or bills and the like, which includes two oppositely arranged, contacting transport belts for receiving the bills therebetween. The transport belts are conjointly rotatably supported by a rotating assembly to serve as a sheet inverter.

SUMMARY OF THE INVENTION

In accordance with the present invention there is provided a sheet inverter having two spaced apart sheet transport units and a rotation device, the rotation device supporting the sheet transport units in a rotatable manner about a common axis of rotation, the sheet transport units each comprising:

at least one transport element, which provides a direction of transport that extends parallel to the axis of rotation;

a controllable drive unit for driving the transport element; and wherein the rotation device is adapted to move the sheet transport units in an alternating manner between an input position and an output position, wherein the sheet transport unit in the input position is aligned with a transport unit arranged upstream to the sheet inverter and the sheet transport unit in the output position is aligned with a transport unit arranged downstream from the sheet inverted.

Advantageously, the sheet transport units each comprise a transport length, which is at least equal to the maximum length of a sheet to be received. Thereby, sheets having the full length of the inverter unit can be inverted without problems.

For a simple construction of the inverter and of the transport units arranged before and behind the same, the axis of rotation can extend centrally between the sheet transport units.

For adjusting the distance between subsequent sheets and also for other reasons it can be beneficial that the drive units for the sheet transport units are independently controllable. Furthermore, at least one control unit for controlling the drive speed of the sheet transport units can be provided.

According to one embodiment, the at least one transport element is a rotatable transport belt having a flat transport section, wherein the flat transport section preferably has a length which is longer than or equal to the maximum length of a sheet to be inverted. This enables safe inversion of the sheet. The at least one rotatable transport belt is preferably a suction belt and/or a belt that can be statically charged, and a suction unit and/or a device for statically charging and discharging of the belt is provided.

For a secure guiding and a secure transport of the sheet during the inversion, the sheet transport units each have at least two rotating transport belts, which are synchronously drivable and which are optionally arranged symmetrical with respect to a longitudinal central plane of the sheet inverter. Furthermore, the sheet transport unit may have adjacent to the transport elements at least one guide surface, which lies in substance in the transport plane of the transport elements. The guide surface should be offset to the transport plane by a maximum of three times the thickness of the belt. For a preferred two sided guidance (on the front and the back), the sheet transport units can each have a guide element which is arranged opposite the guide surface.

In the method for inverting sheets, at least one first sheet is received by a sheet transport unit, which is in an input position and the at least one first sheet is moved in a direction of transport by the sheet transport unit. The first sheet transport unit is rotated, while it has received the at least one first sheet around an axis of rotation, which extends parallel to the direction of transport into an output position and the at least one received sheet is then moved and output in the direction of transport or into an opposite second direction. While the first sheet transport unit is rotated from the input position to the output position, a second sheet transport unit is rotated from the output position to the input position, in order to receive at least one second sheet, while the first sheet transport unit outputs the at least one first sheet. Such a method enables a simple inversion or a change of the direction of transport for sheets of different sizes.

In one embodiment, the transport speeds of the sheet transport units are individually controlled in the respective input/output positions based on a predetermined profile. In particular, the speed of movement increases towards the end of the movement when receiving the sheet in the input position and when outputting the sheet in the output position, it is initially higher than towards the end. In so doing, the spacing between subsequent sheets may initially be enlarged while receiving the sheet, in order to avoid any disruption while rotating the sheet transport units, which spacing may then again be shortened while outputting the sheets. The increased speeds could in particular be provided when the sheet is not in contact with other transport units which may for example be arranged before or after the sheet inverter.

In a preferred embodiment, receiving an outputting of the sheet occurs in the same direction, such that the leading edge and the trailing edge are not changed during the inversion process.

The above and further objects, features and advantages of the invention will be made clearer in combination with the following description and the drawings, in which, where possible, the same reference signs were used to refer to identical or similar features; in the drawings:

Figure 1:
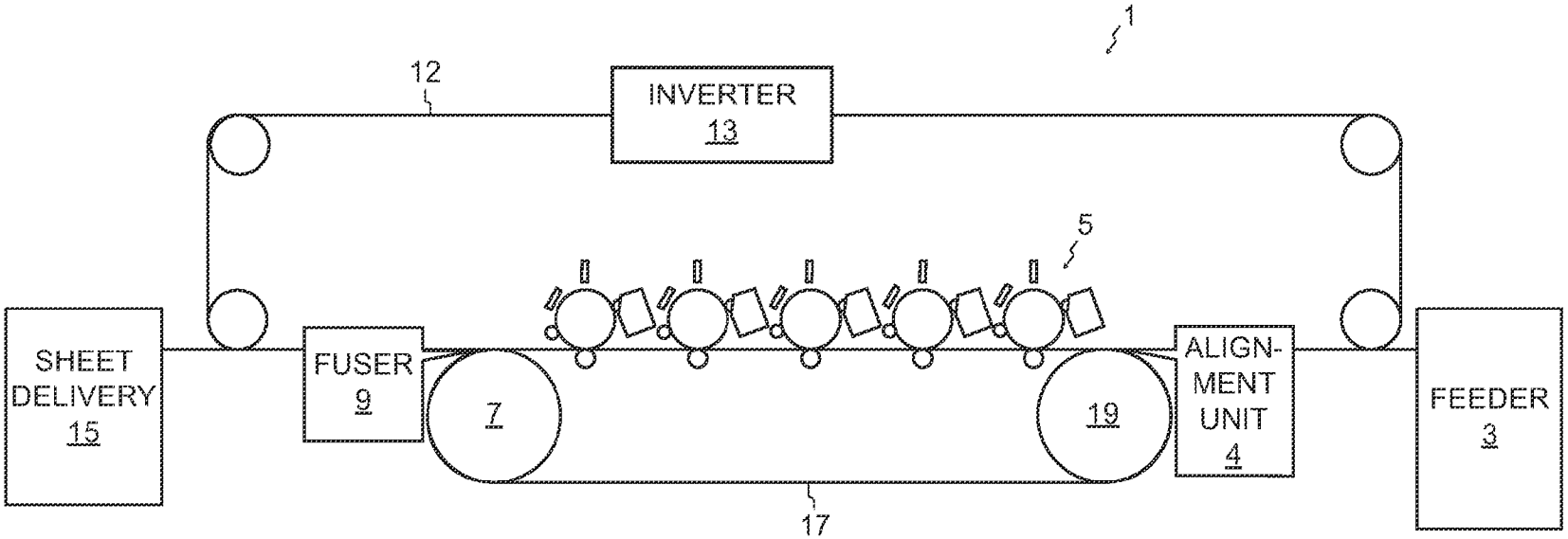
FIG. 1 is a schematic side view of a printer, in which an inverter in accordance with the invention may be used.

Terms which refer to arrangements and directions, such as above, below, and which are used in the specification refer to the representation in the drawings and are not considered to be limiting the scope of the invention. They can, however, refer to a preferred final arrangement of elements.

DETAILED DESCRIPTION OF THE INVENTION

FIG. 1 is a schematic side view of a multicolor printer 1 having a feeder 3, an alignment unit 4, a plurality of print units 5, a transport unit 7, a fuser 9, a duplex path 12 having an inverter 13, and a sheet delivery 15. Many different types of single or multicolor printers are known and FIG. 1 only shows a simplified example of such printer 1.

The feeder 3 is constructed to receive a stack of sheets and to feed the sheets individually to the alignment unit 4. The feeder 3 is arranged, as shown, at a first end of the printer 1. The feeder 3 can be arranged at any other position and does not have to feed the sheet directly to the alignment unit 4. The alignment unit 4 is of a suitable type which aligns the sheets delivered thereto and transfers the same to the transport unit 7. The transport unit 7 has a known construction and is adapted to move the sheets along the print units 5. In the embodiment as shown, the transport unit 7 has an endless transport belt 17, which is entrained around respective transport and guide rollers 19.

The print units 5 are arranged adjacent to the transport belt 17 and are suited for respectively printing color separations onto the sheets, which are moved by the transport belt 17 along the print units 5. The printer 1 has, as shown, five print units 5 but can also have any other number of print units 5. The print units 5 are shown as electrophotographic print units, but they can be of any other type, which is suited for transferring a print material such as a toner or ink onto a sheet for forming an image such as for example of an ink-jet print unit.

The fuser 9 is arranged downstream with respect to the transport unit 7 in order to receive the sheets after printing thereon by way of the print units 5. The fuser 9 can be of any suitable type for fusing or fixing the print material which was previously printed onto the sheet. This can for example be achieved by way of heated pressure rollers or by way of any other suitable device such as a non-contact heating device which can for example work with light or other electromagnetic radiation, such as for example microwaves.

Adjacent to the fuser 9, there is a duplex path 12 which provides a sheet transport path back to the alignment unit 4. In the duplex path 12 the inverter 13 is provided, which will be described in more detail herein below, and which is suited to invert a sheet while it is transported along the duplex path 12. When a sheet has passed through the fuser 9 and is not to be guided to the duplex path 12, it is also possible to guide the sheet via a suitable diverter towards the sheet delivery 15.

Figure 2:
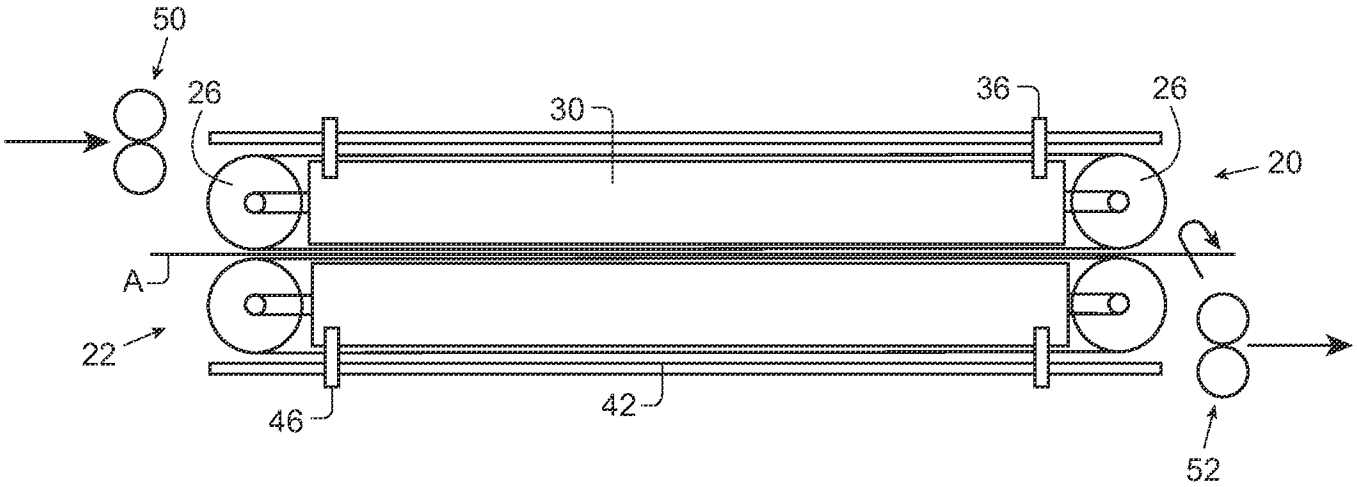
FIG. 2 is an enlarged schematic side view of the inverter of FIG. 1.
Figure 3:
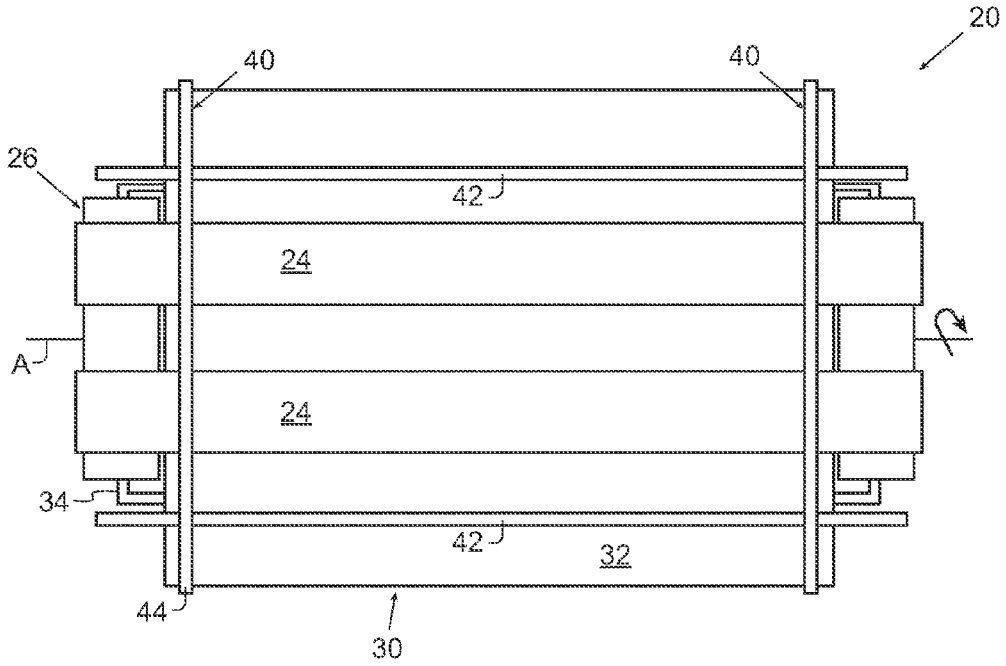
FIG. 3 is an enlarged schematic top view of the inverter according to FIG. 1.

With reference to FIGS. 2 and 3, the inverter 13 will be described in more detail. The inverter 13 consists in substance of two transport units 20, 22, which are mounted to a common rotation device and which are mounted around a common axis of rotation A. The rotation device is not shown in detail, since rotation devices are generally known. Only the axis of rotation A is shown in FIGS. 2 and 3.

The transport units 20, 22 can be constructed in substance identically and therefore in the following, only in the transport unit 20 is described in more detail. The transport unit 20 includes at least one transport element for transporting a sheet along a transport path, which extends in substance in parallel to the axis of rotation A.

In the embodiment as shown, the transport unit 20 has two transport belts 24 of the suction type (including openings for guiding air there through) which are entrained about spaced transport rollers 26. Of these transport rollers 26 at least one is connected to a drive unit, which is not shown. The transport belts 24 are entrained about the transport rollers 26 such that between the transport rollers 26 two straight sections are formed, wherein one section forms a transport section and the other section forms a return section, as is known in the art. The transport belts 24 extend parallel to each other and the straight sections are arranged in a common plane. The parallel extending transport belts 24 can be guided at their ends about a common transport roller 26 as shown or they can be guided around individual transport rollers 26. In lieu of the two transport belts a single transport belt or more transport belts can be provided, which are preferably arranged symmetrically with respect to a longitudinal central plane of the transport unit 20.

Between the transport rollers 26 and the straight sections of the transport belts 24 a housing 30 is provided. In the housing 30 a vacuum device is provided for applying a negative pressure to the straight sections of the transport belts 24 as is common in the art of suction belts. The housing 30 is arranged such that it guides and supports the straight sections of the transport belts 24. The housing 30 has the width such that it forms a guide surface 32 between the transport belts 24 and laterally thereto. The guide surface 32 provides guidance for the sheets to be transported with the transport belts 24, which guide surface is substantially in the plane of the transport belts 24 (laterally adjacent to the transport section). In the area of the transport belts 24, the housing 30 can optionally have recesses corresponding to the thickness of the transport belts 24.

The transport rollers 26 are mounted in a suitable manner to the housing 30 via a bracket 34. Furthermore, an optional guide unit 36 can be provided on the housing 30, which provides guidance for sheets during rotation of the transport unit 20, 22, which guidance is opposite to the guide surface 32, as will be explained herein below. The guide unit 36 is formed by two transverse brackets 40 and two longitudinal guides 42. The transverse brackets 40 each have a section 44 having a width corresponding to the width of the housing 30 as well as angled sections 46 at the ends of the section 44, for mounting to the sidewalls of the housing 30. The transverse brackets 40 extend transverse to the direction of transport of the transport belts 24 and are mounted at respective end sections of the housing 30 in the longitudinal direction thereof. The longitudinal guides 36, of which more than two can be provided, extend parallel to the direction of transport of the transport belts 24 and are mounted to the transverse bracket 40 such that they are arranged between the transverse brackets 40 and the guide surface 32 of the housing 30. The longitudinal guides 42 extend in substance over the complete length of the transport unit 20.

The transport units 20, 22 are, as explained above, mounted to a common rotation device. They can also be mounted to each other. The transport units 20, 22 are arranged such that their respective transport sections (formed by the straight transport sections of the transport belts 24) face in opposite directions. Thereby, two parallel transport planes are formed, wherein in the representation of FIG. 2 the upper transport plane is an input plane and the lower transport plane is an output plane. The transport units 20, 22 can be moved alternately by the rotation device between an input position (transport in the input plane) and an output position (transport in the output plane). This can be achieved by either using a constant direction of rotation or opposite directions of rotations.

At the level of the input plane a further transport unit 50 is provided. The transport unit 50 can be part of the inverter 13 or it can also be part of the duplex path 12. The transport unit 50 includes a pair of transport rollers forming a transport nip there between for transporting sheets, as is known in the art. The transport unit 50 can be controlled to feed a sheet in the direction of a transport unit 20, 22 located in the input position. The transport unit 50 thus serves to feed a sheet into the inverter 13. In a similar manner a further transport unit 52 is provided at the level of the output plane for transporting a sheet out of the inverter 13.

Operation of the printer 1 and in particular of the inverter 13 will be described herein below with reference to FIGS. 1-3 using the example of duplex printing onto a sheet, such as a paper sheet via electrophotographic print units.

Initially, the feeder 3 is operated to feed a sheet to the alignment unit 4. In the alignment unit 4 the sheet is aligned in a suitable manner. Subsequently, the sheet is transferred to the transport belt 17 of the transport unit 7 and held thereon for example by electrostatic attraction. The transport belt 17 is driven in a rotary manner to transport the sheet along the transport units 7, which provide a toner image on an upwardly facing first side of the sheet. By way of the plurality of print units, separate color separations of a multicolor image are transferred in a suitable manner onto the sheet. Now, the sheet with the toner layers thereon is transported through the fuser 9, in which the toner image is fused to the sheet. The sheet is then guided towards the duplex path 12, in which the sheet is inverted by the inverter 13. Subsequently the sheet is fed in an inverted manner, i.e. the first side on which it was previously printed now faces downward, into the alignment unit 4. The sheet is again aligned in a suitable manner and transferred to the transport belt 17 to be transported along the print units 5 for transferring a toner image to the second side of the sheet. The toner image is then fused to the sheet in the fuser 9 and the sheet is finally transported to the sheet delivery 15.

The inverting process is described herein below in more detail with respect to FIGS. 2 and 3. The sheet is transported via the transport unit 50 into the inverter 13, where it is received and transported by the transport belt 24 of the transport unit 20, 22, which is currently in the input position (the upper position). The transport speed of the transport belt 24 can be controlled such that it is increased as soon as the sheet is released from the transport unit 50, in order to increase the spacing to the subsequent sheet. As soon as the sheet is released by the transport unit 50, the rotation device can rotate the transport unit 20, 22 from the input position to the output position. During this rotation the transport in the direction of transport can be continued. During the rotation, the sheet (in particular lateral portions thereof) can be guided by the guide surface 32 and/or the longitudinal guides 42, in order to avoid twisting or bending of the lateral portions. In the output position of the transport unit 20, 22 the sheet is then transported towards the transport unit 52 where it exits the transport unit. The transport speed can initially be higher, until the sheet reaches the transport unit 52, thereby enabling, reducing or adjusting the spacing to a previous sheet. Subsequently, the sheet is transported with the transport speed of the transport unit 52 until it is released from the transport belt 24. While the sheet is output from the transport unit 20, 22 in the output position, the other transport unit 22, 20, which is now in the input position, can receive a further sheet, such that sheets can in substance, be continuously transported and inverted by the inverter 13.

The maximum length of the sheet corresponds in substance to the length of the transport section of the transport units 20 22. Thus, in comparison to a device as described in the introductory portion of the application, longer sheets can be transported and inverted (assuming the same length of the inverter) irrespective of the stiffness of the sheet. The transport units 20, 22 can, depending on the length of the sheets, receive several sheets prior to the rotation device rotating the respective transport unit 20, 22 from the input position to the output position, thereby inverting several sheets at the same time. Using a respective speed control of the transport belts 24 in the input and output positions of the transport units 20, 22 it is possible to continuously receive and invert sheets and also keep the spacing between subsequent sheets in substance constant.

The invention is described with reference to a currently preferred embodiment, without being limited to the same. In particular, it is also possible to operate the inverter as a so-called J-inverter by reversing the direction of transport of the transport units in the input and output position. Furthermore, in lieu of the transport belts 24, as shown in the transport units 20, 22, also a plurality of transport rollers may be provided, which are commonly rotated about the axis of rotation A. Also, statically chargeable belts and respective static charging and discharging devices can be provided instead of the suction belts, in order to achieve attraction/release of the sheets. Even though the device is described as an inverter, in which the leading edge and the trailing edge is not changed during the inverting process, the device can also be operated as a reversing unit using rotation of the transport units or may also be operated as a so called J-inverter without rotating the transport units. It is in particular also possible to receive sheets in parallel in the transport units and to output the same after a rotation, such that two simultaneous inverting processes are possible. It is noted that variations, combinations and modifications to these embodiments can be made by the skilled person which are considered to lie within the spirit and scope of the invention.

PARTS LIST

1 printer
3 feeder
4 alignment unit
5 print units
7 transport unit
9 fuser
12 duplex path
13 inverter
15 sheet delivery
17 endless transport belt
19 guide rollers
20 first sheet transport unit
22 first sheet transport unit
24 at least one rotating transport belt
26 common transport roller
30 housing
32 at least one guide surface
34 bracket
40 transverse brackets
42 longitudinal guides
44 at least one guide element
46 angled sections
50 transport unit
52 downstream transport unit

The invention claimed is:

1. A sheet inverter having two spaced apart sheet transport units and a rotation device, the rotation device supporting the sheet transport units in a rotatable manner about a common axis of rotation, the sheet transport units each comprising:

at least one transport element, which provides a direction of transport that extends parallel to the axis of rotation;

a controllable drive unit for driving the transport element; and wherein the rotation device is adapted to move the sheet transport units in an alternating manner between an input position and an output position, wherein the sheet transport unit in the input position is aligned with a transport unit arranged upstream to the sheet inverter and the sheet transport unit in the output position is aligned with a transport unit arranged downstream from the sheet inverted, wherein the axis of rotation extends centrally between the sheet transport units.

2. The sheet inverter according to claim 1, wherein the sheet transport units each have a transport length which is equal to the maximum length of a sheet to be received.

3. The sheet inverter according to claim 1, wherein the upstream transport unit is arranged on a first end of the sheet inverter and the downstream transport unit is arranged on the opposite end of the sheet inverter in the direction of transport.

4. The sheet inverter according to claim 1, wherein the at least one transport element is at least one rotating transport belt having a flat transport section.

5. The sheet inverter according to claim 1, wherein the at least one rotating transport belt is a suction belt and/or statically chargeable belt, and wherein a suction unit and/or a device for statically charging and discharging the transport belt is provided.

6. The sheet inverter according to claim 1, wherein the sheet transport units each comprise two rotating transport belts which are synchronously drivable and which are also symmetrically arranged with respect to a longitudinal central plane of the sheet inverter.

7. The sheet inverter according to claim 1, wherein the sheet transport units comprise at least one guide surface laterally adjacent to the transport elements, which guide surface is at the same level as the transport plane of the transport elements.

8. The sheet inverter according to claim 7, wherein the sheet transport units each comprise at least one guide element, which is arranged opposite to the guide surface.

9. The sheet inverter according to claim 1, comprising a control unit for controlling the drive speed of the feed transport unit.

10. A method for inverting sheets, in which at least one first sheet is received and transported in a direction of transport by a first sheet transport unit located in an input position, wherein the first sheet transport unit, while it has received the at least one first sheet, is rotated around an axis of rotation which extends parallel to the direction of transport into an output position, and wherein the at least one received sheet is transported and output in the direction of transport or in the opposite direction, wherein while the first sheet transport unit is rotated from the input position to the output position, a second sheet transport unit is rotated from the output position to the input position in order to receive at least one second sheet in said input position, while the first sheet transport unit outputs the at least one first sheet.

11. The method of claim 10, wherein the transport speeds of the sheet transport units are individually controlled in the respective positions in accordance with a predetermined profile.

12. The method of claim 11, wherein the transport speed when receiving the at least one sheet increases towards the end of the movement and when outputting the at least one sheet is initially higher than later.

13. The method according to claim 10, wherein receiving and outputting the sheet occurs in the same direction.

14. A sheet inverter having two spaced apart sheet transport units and a rotation device, the rotation device supporting the sheet transport units in a rotatable manner about a common axis of rotation, the sheet transport units each comprising:

at least one transport element, which provides a direction of transport that extends parallel to the axis of rotation;

a controllable drive unit for driving the transport element; and wherein the rotation device is adapted to move the sheet transport units in an alternating manner between an input position and an output position, wherein the sheet transport unit in the input position is aligned with a transport unit arranged upstream to the sheet inverter and the sheet transport unit in the output position is aligned with a transport unit arranged downstream from the sheet inverted, wherein the drive units of the sheet transport units are independently controllable.

15. The sheet inverter according to claim 14, wherein the sheet transport units each have a transport length which is equal to the maximum length of a sheet to be received.

16. The sheet inverter according to claim 14, wherein the upstream transport unit is arranged on a first end of the sheet inverter and the downstream transport unit is arranged on the opposite end of the sheet inverter in the direction of transport.

17. The sheet inverter according to claim 14, wherein the at least one transport element is at least one rotating transport belt having a flat transport section.

18. The sheet inverter according to claim 14, wherein the at least one rotating transport belt is a suction belt and/or statically chargeable belt, and wherein a suction unit and/or a device for statically charging and discharging the transport belt is provided.

19. The sheet inverter according to claim 14, wherein the sheet transport units each comprise two rotating transport belts which are synchronously drivable and which are also symmetrically arranged with respect to a longitudinal central plane of the sheet inverter.

20. The sheet inverter according to claim 14, wherein the sheet transport units comprise at least one guide surface laterally adjacent to the transport elements, which guide surface is at the same level as the transport plane of the transport elements.

* * * * *